US007815178B1

(12) United States Patent
Troutman

(10) Patent No.: US 7,815,178 B1
(45) Date of Patent: Oct. 19, 2010

(54) CLAMPING MACHINE

(75) Inventor: Donald E. Troutman, Paragould, AR (US)

(73) Assignee: Lucille Troutman, Paragould, AR (US)

( * ) Notice: Subject to any disclaimer, the term of this patent is extended or adjusted under 35 U.S.C. 154(b) by 1191 days.

(21) Appl. No.: 11/383,625

(22) Filed: May 16, 2006

(51) Int. Cl.
*B25B 5/00* (2006.01)

(52) U.S. Cl. ..... 269/43; 269/45; 269/59

(58) Field of Classification Search ..... 269/43, 269/45, 71–75, 95, 59; 29/281.1
See application file for complete search history.

(56) References Cited

U.S. PATENT DOCUMENTS 5,330,167 A * 7/1994 Plumb ..... 269/43
6,431,534 B1 * 8/2002 Orosz et al. ..... 269/43
6,530,566 B1 * 3/2003 DuVernay ..... 269/228
6,754,941 B2 * 6/2004 Schlusselbauer ..... 29/239
7,040,610 B2 * 5/2006 Hubbard ..... 269/267
2005/0225019 A1 * 10/2005 Hubbard ..... 269/267

* cited by examiner

*Primary Examiner*—Lee D Wilson
(74) *Attorney, Agent, or Firm*—Joe D. Calhoun; Rashauna A. Norment

(57) ABSTRACT

A device allowing essentially simultaneous clamping of at least two clamps, that may have different clamping strengths and/or clearance capacities.

17 Claims, 11 Drawing Sheets

CLAMPING MACHINE

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of the Invention

This invention generally relates to clamping devices, especially for transporting items on an all terrain vehicle ("ATV") or similar vehicle.

The present invention is directed primarily towards a device allowing simultaneous clamping of at least two clamps, especially in situations needing clamps having different clamping strengths and/or clearance capacities.

(2) Description of Related Art Including Information Disclosed 37 CFR 1.97 and 1.98

Known in the art are the following, arguably related to the patentability of the present invention:

U.S. Pat. No. 2,157,345 issued May 9, 1939 to Nelson;

U.S. Pat. No. 4,176,830 issued Dec. 4, 1979 to Isley;

U.S. Pat. No. 4,915,273 issued Apr. 10, 1990 to Allen;

U.S. Pat. No. 5,141,214 issued Aug. 24, 1992 to Munoz;

U.S. Pat. No. 5,351,943 issued Oct. 4, 1994 to Milz; and

U.S. Pat. No. 6,595,375 issued Jan. 21, 1997 to Benhausen.

U.S. Pat. No. 4,915,273 issued to Allen discloses a pair of clamping brackets attached to an ATV, for holding a rifle or other such item. Each bracket uses spring tension to bias a movable clamping plate toward a fixed plate, to accomplishing clamping of the rifle between the plates when the rifle is forced between the fixed and movable plates. The Allen patent does not disclose movement of a shared actuator lever essentially causing each movable portion to simultaneously move toward the respective fixed portion to accomplish clamping. Neither does that patent disclose other features of the present invention, such as a locking mechanism that quickly locks and unlocks the clamping.

U.S. Pat. No. 5,351,943 issued to Milz discloses two vises actuated by screw threads on a common shaft, that are operated simultaneously by rotation of the end of the shaft. The Milz patent does not disclose a dual clamping mechanism having a shared actuator lever essentially causing each movable portion to simultaneously move toward the respective fixed portion to accomplish clamping. Neither does that patent disclose other features of the present invention, such as a locking mechanism that quickly locks and unlocks the clamping.

BRIEF SUMMARY OF THE INVENTION

The present invention is a machine for essentially simultaneously clamping an item releasably with a plurality of clamps, said machine comprising (including) a plurality of clamping means and a means of actuating said clamping means.

One primary object of the present invention is to provide a clamping device that uses a single actuator lever to close at least two clamps essentially simultaneously.

Another primary object of the present invention is to provide a clamping device providing simultaneously actuated clamps, each having a different clamping strength and/or clearance capacity from the other(s).

It is another object of the present invention to provide a clamping device using a single actuator lever to close at least two clamps essentially simultaneously, and that can be readily and quickly locked or unlocked.

It is another object of the present invention to provide a clamping device allowing the simultaneous clamping and unclamping of an item having ends that have different thicknesses.

It is another object of the present invention to provide a clamping device that is readily mounted to a vehicle, especially an ATV, especially on the ATV handle bars.

Other objects will be apparent from a reading of the written description disclosed herein, together with the claims.

BRIEF DESCRIPTION OF THE SEVERAL VIEWS OF THE DRAWINGS

FIGS. 1 through 16 illustrate certain details of certain embodiments. However, the invention disclosed herein is not limited to only the embodiments so illustrated. The invention disclosed herein may have equally effective or legally equivalent embodiments.

DETAILED DESCRIPTION OF THE INVENTION

Figure 1:
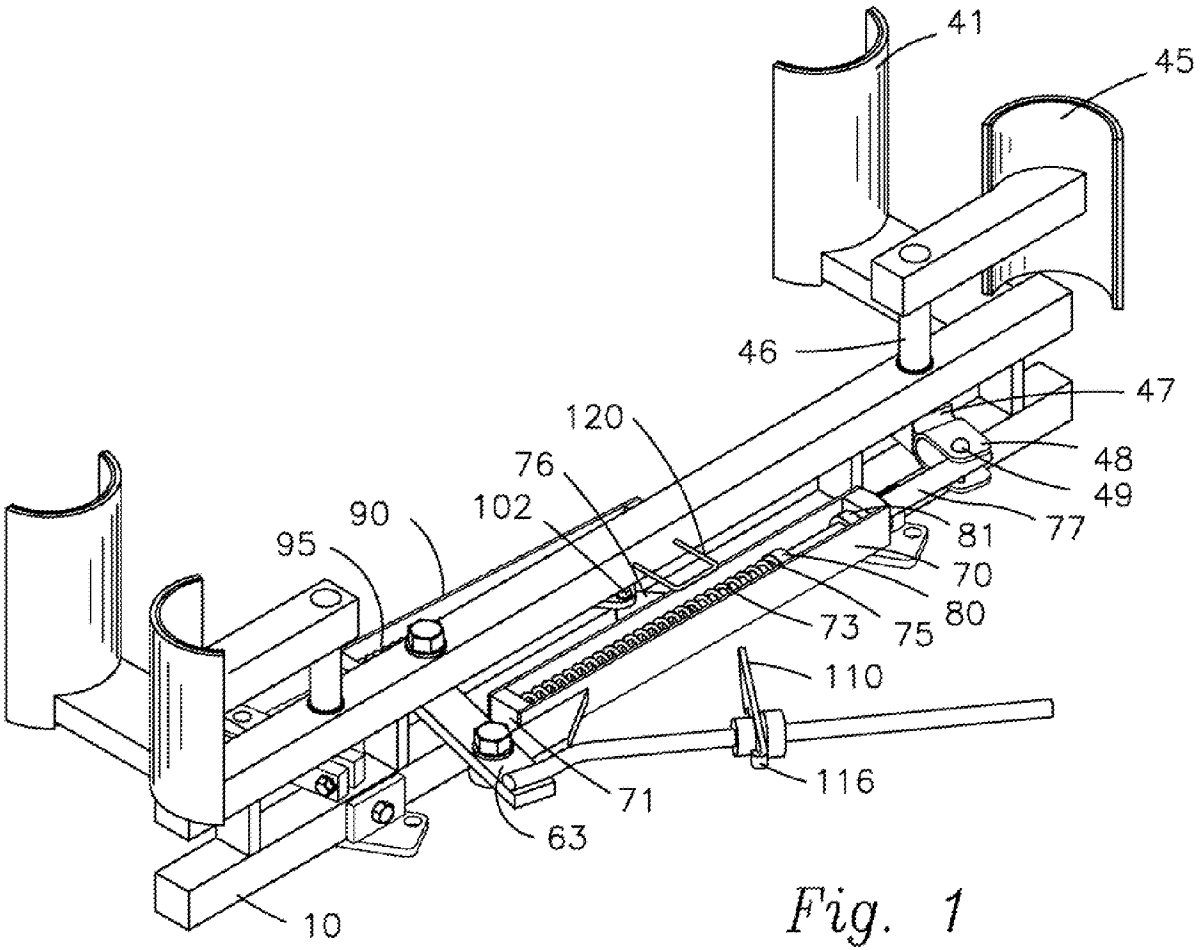
FIG. 1 depicts a perspective view of the invention in its fully open configuration, with both magazine hatches removed.
Figure 2:
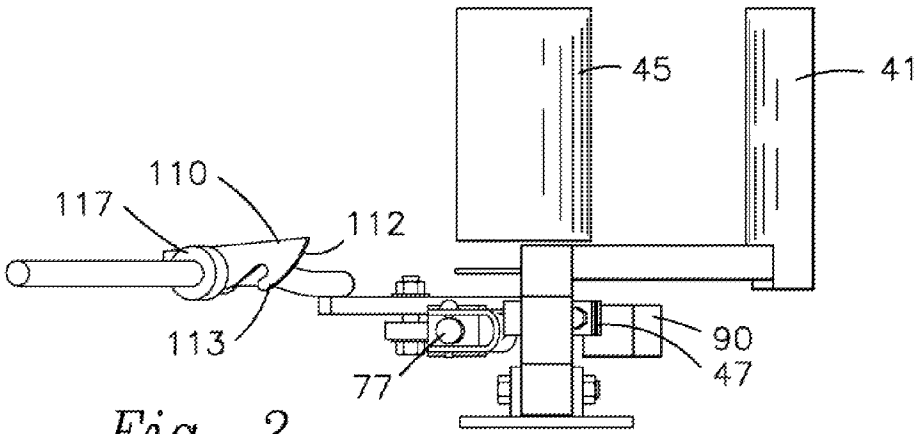
FIG. 2 depicts an elevation view of the right side of the invention of FIG. 1.
Figure 3:
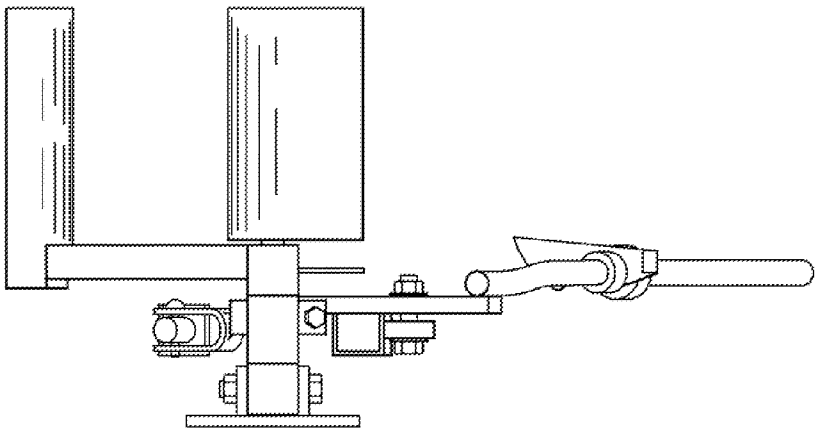
FIG. 3 depicts an elevation view of the left side of the invention of FIG. 1.
Figure 4:
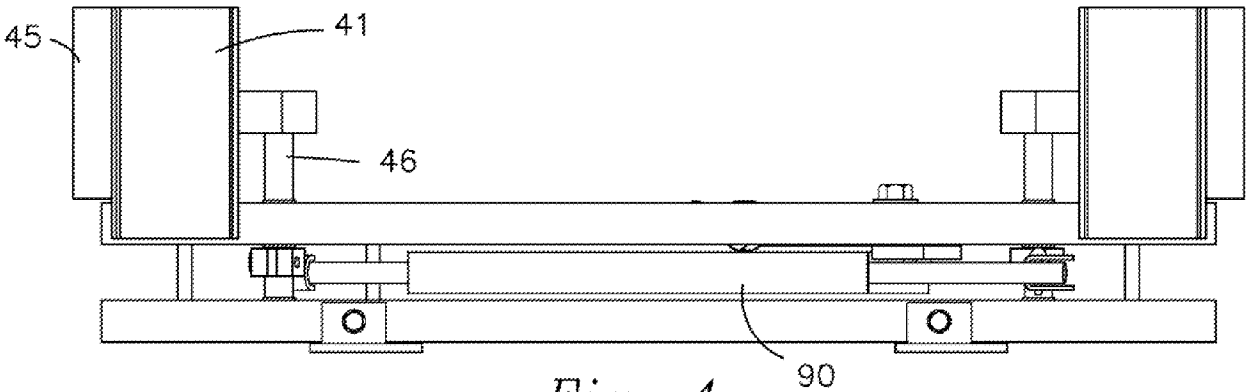
FIG. 4 depicts an elevation view of the forward side of the invention of FIG. 1.
Figure 5:
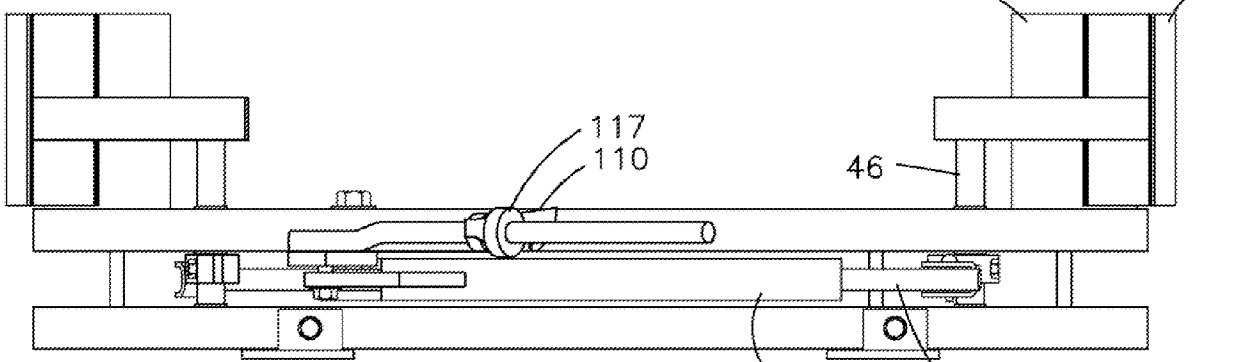
FIG. 5 depicts an elevation view of the rearward side of the invention of FIG. 1.
Figure 6:
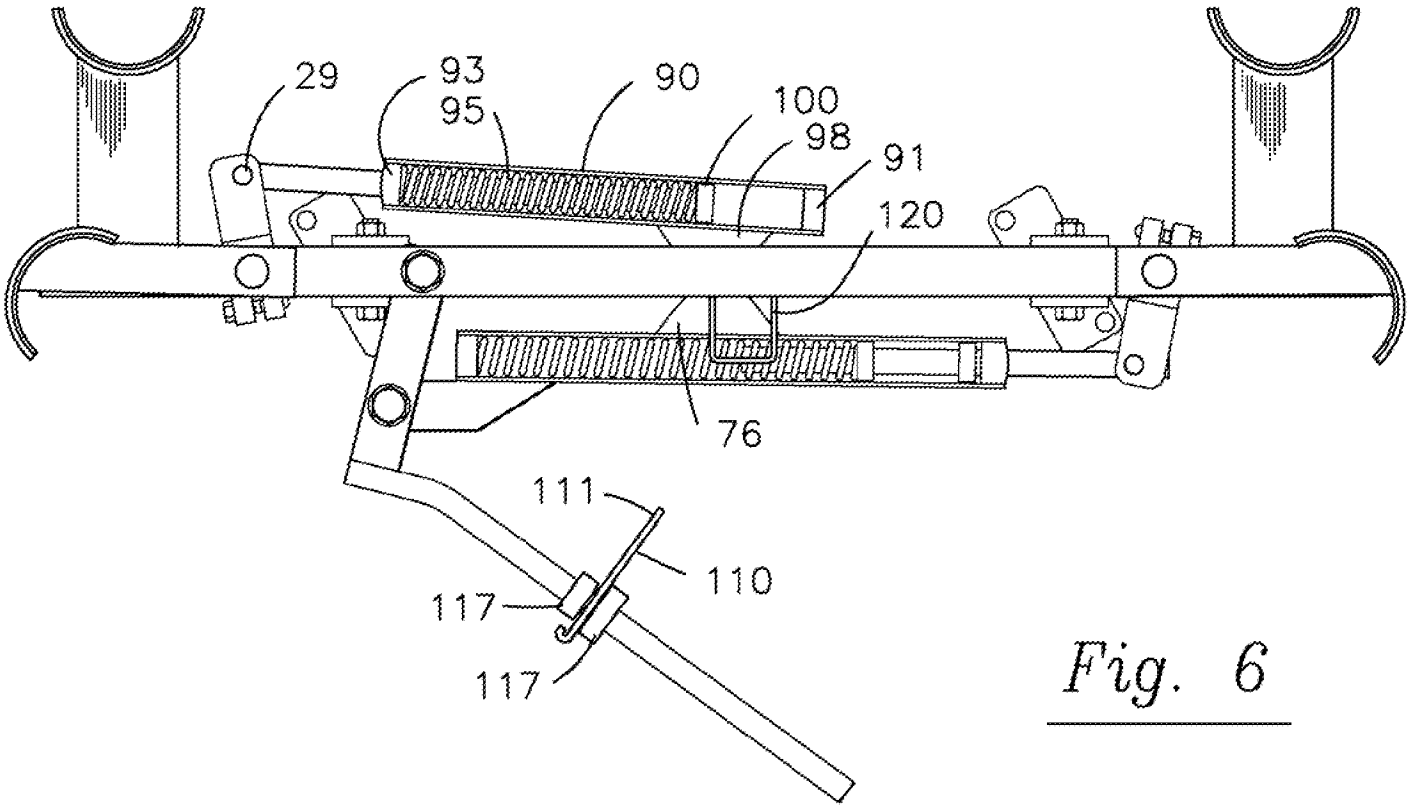
FIG. 6 depicts a top plan view of the invention of FIG. 1.
Figure 7:
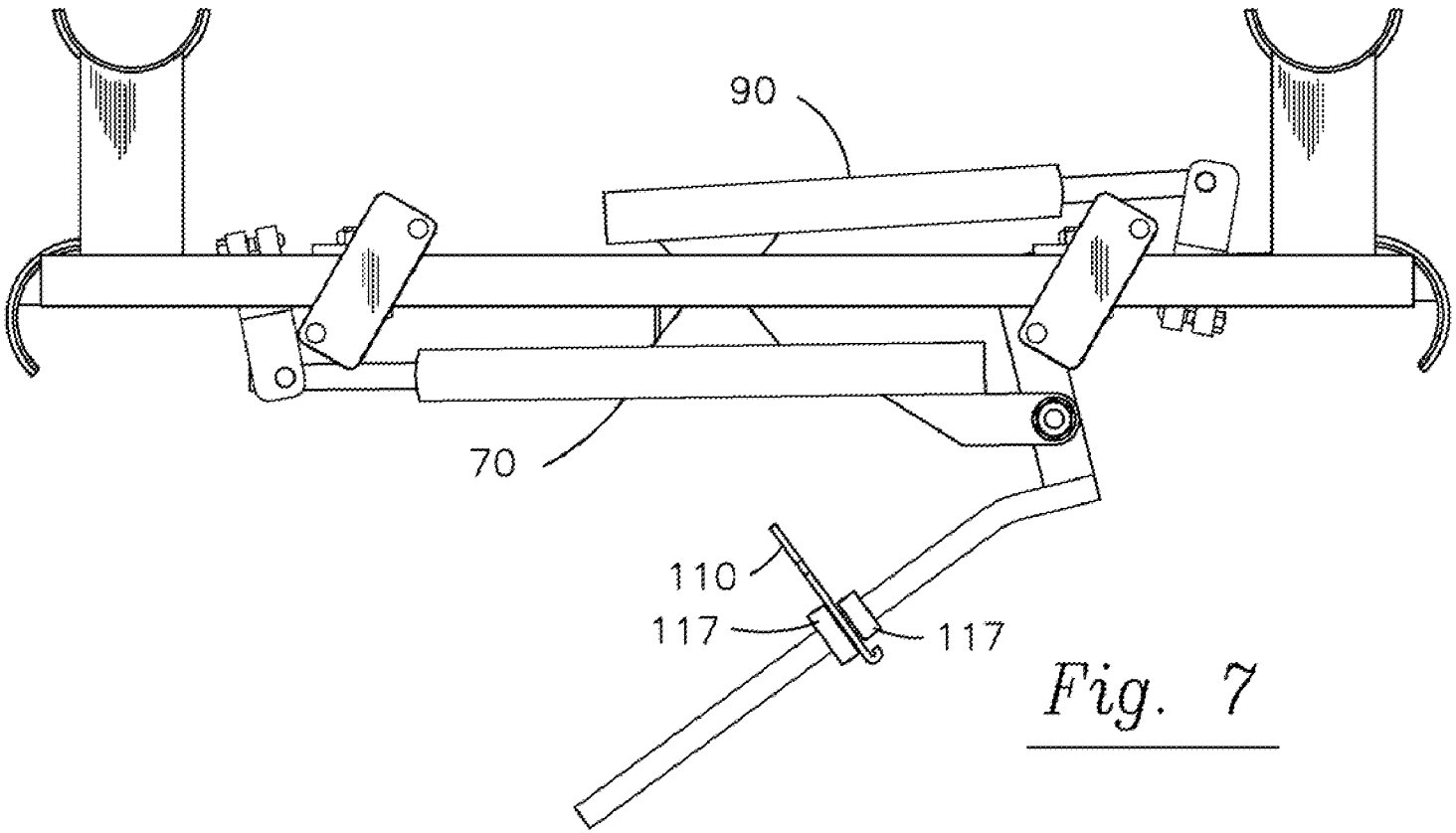
FIG. 7 depicts a bottom plan view of the invention of FIG. 1.
Figure 8:
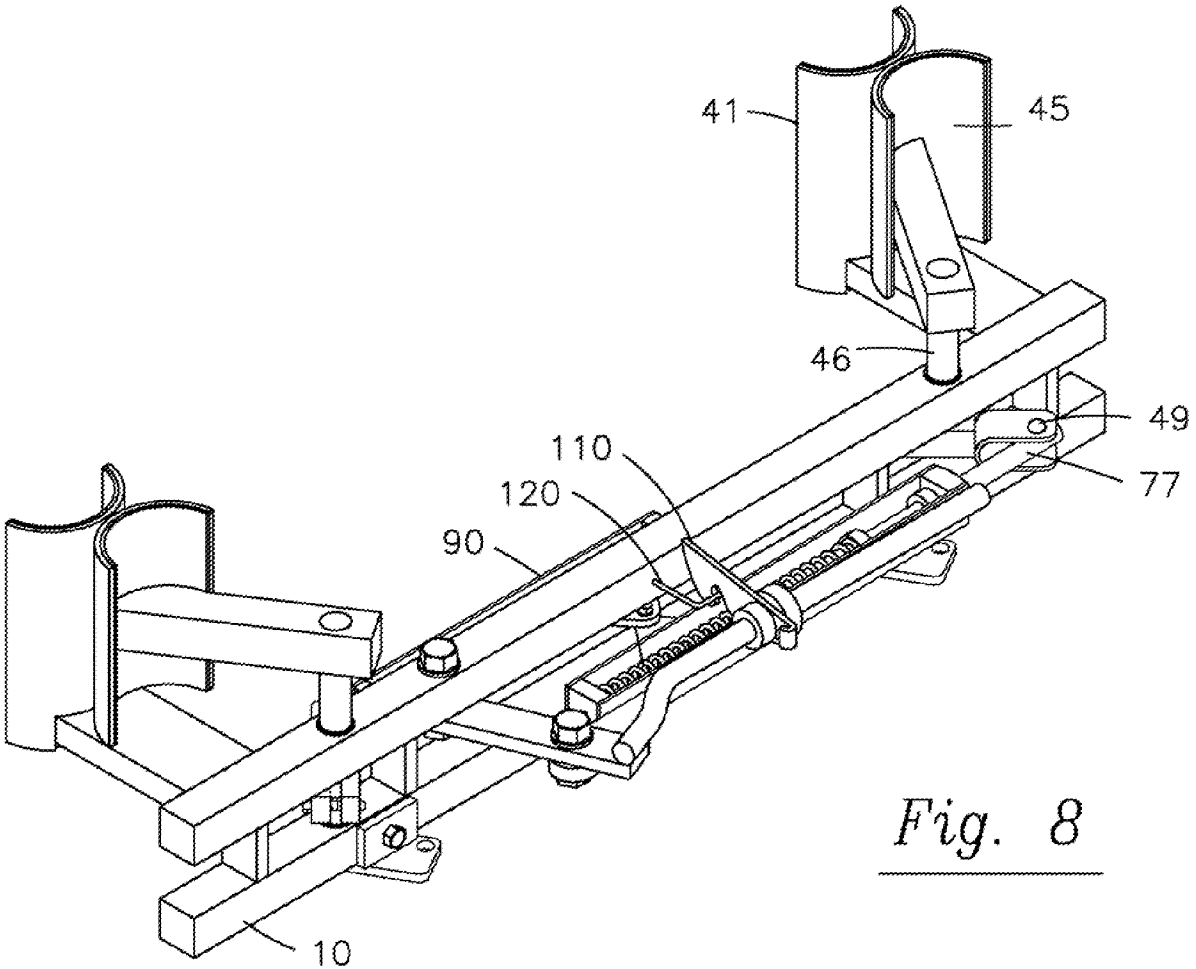
FIG. 8 depicts a perspective view of the invention of FIG. 1, fully clamped and locked, with both magazine hatches removed.
Figure 9:
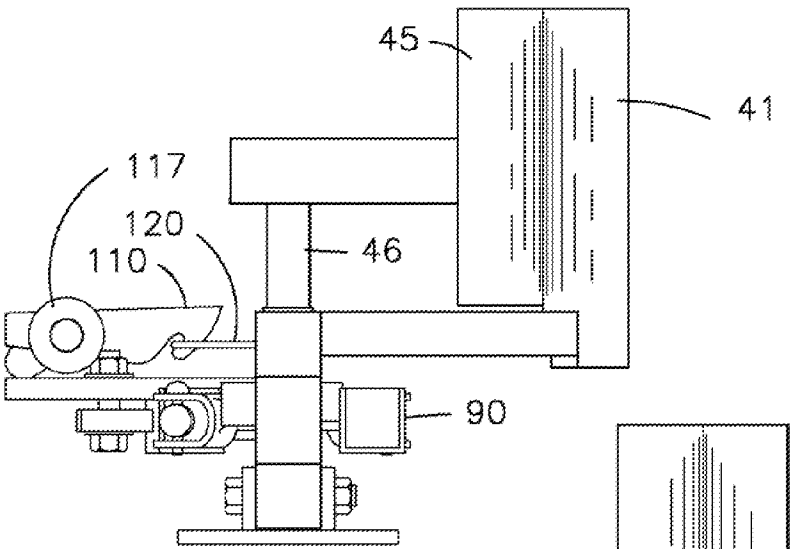
FIG. 9 depicts an elevation view of the left side of the invention of FIG. 8.
Figure 10:
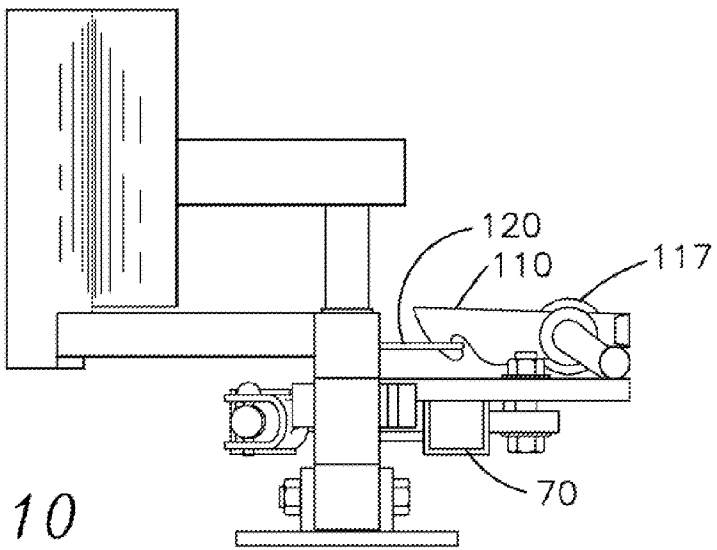
FIG. 10 to depicts an elevation view of the right side of the invention of FIG. 8.
Figure 11:
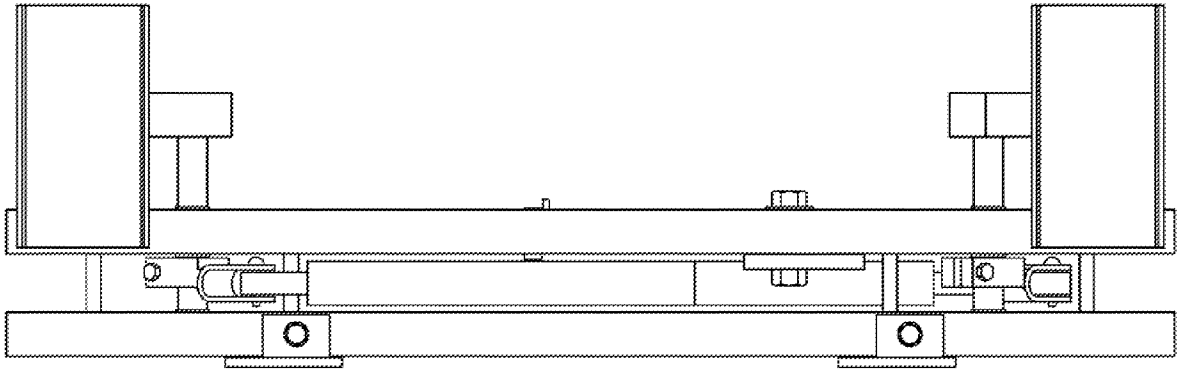
FIG. 11 depicts an elevation view of the forward side of the invention of FIG. 8.
Figure 12:
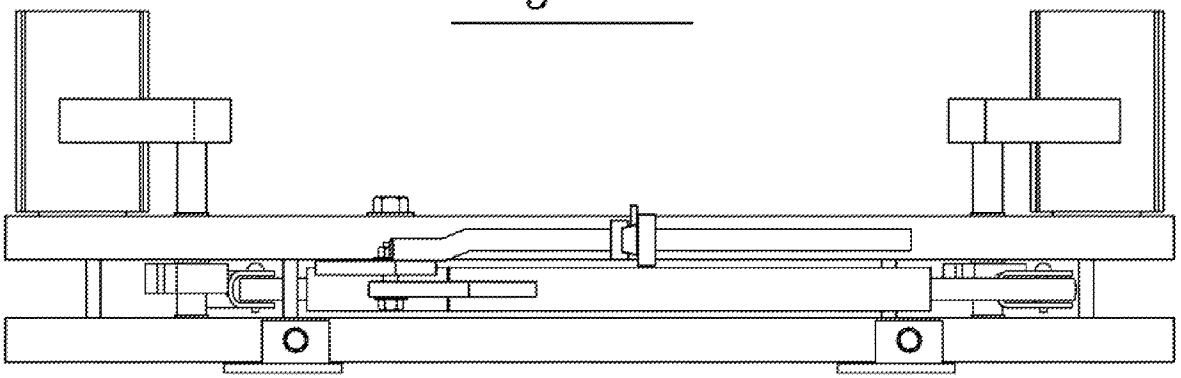
FIG. 12 depicts an elevation view of the rearward side of the invention of FIG. 8.
Figure 13:
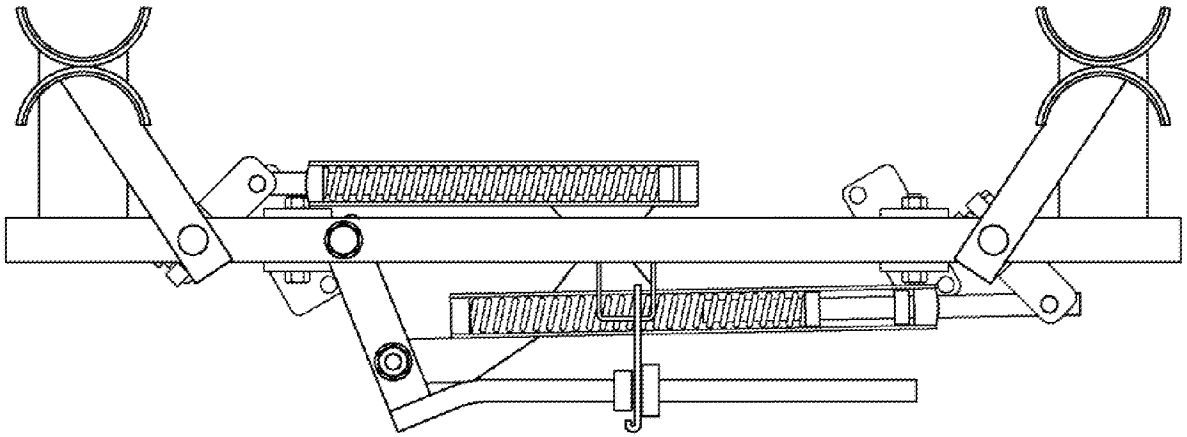
FIG. 13 depicts a top plan view of the invention of FIG. 8
Figure 14:
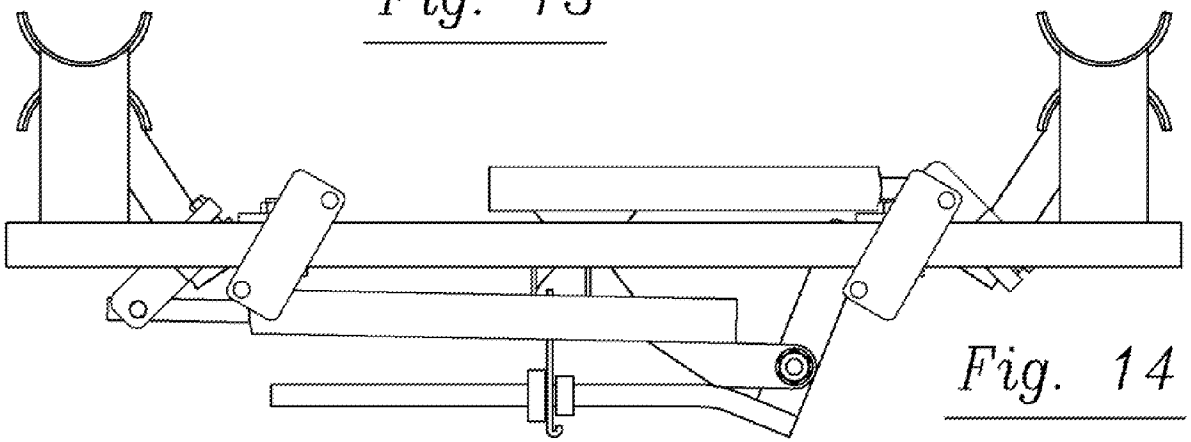
FIG. 14 depicts a bottom plan view of the invention of FIG. 8.
Figure 15:
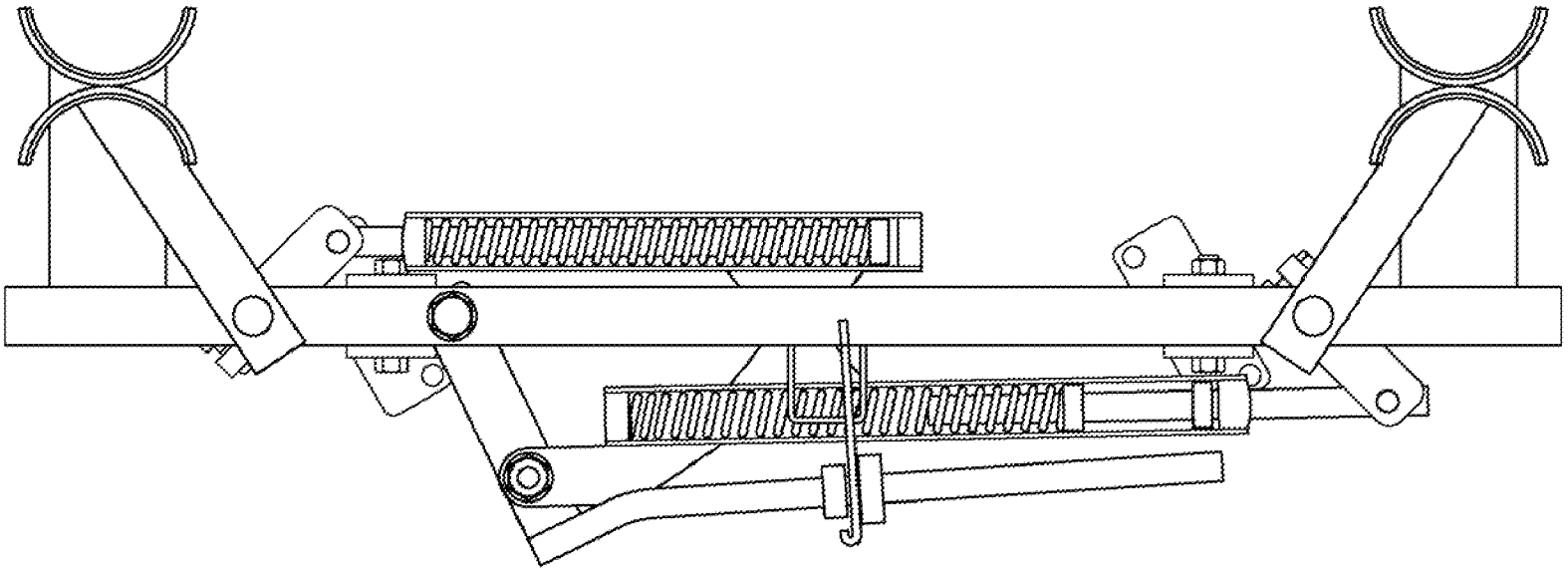
FIG. 15 depicts a top plan view of the invention of FIG. 1, with the actuator handle hyper-extended forward past the fully clamped and locked position, and with both magazine hatches removed.
Figure 16:
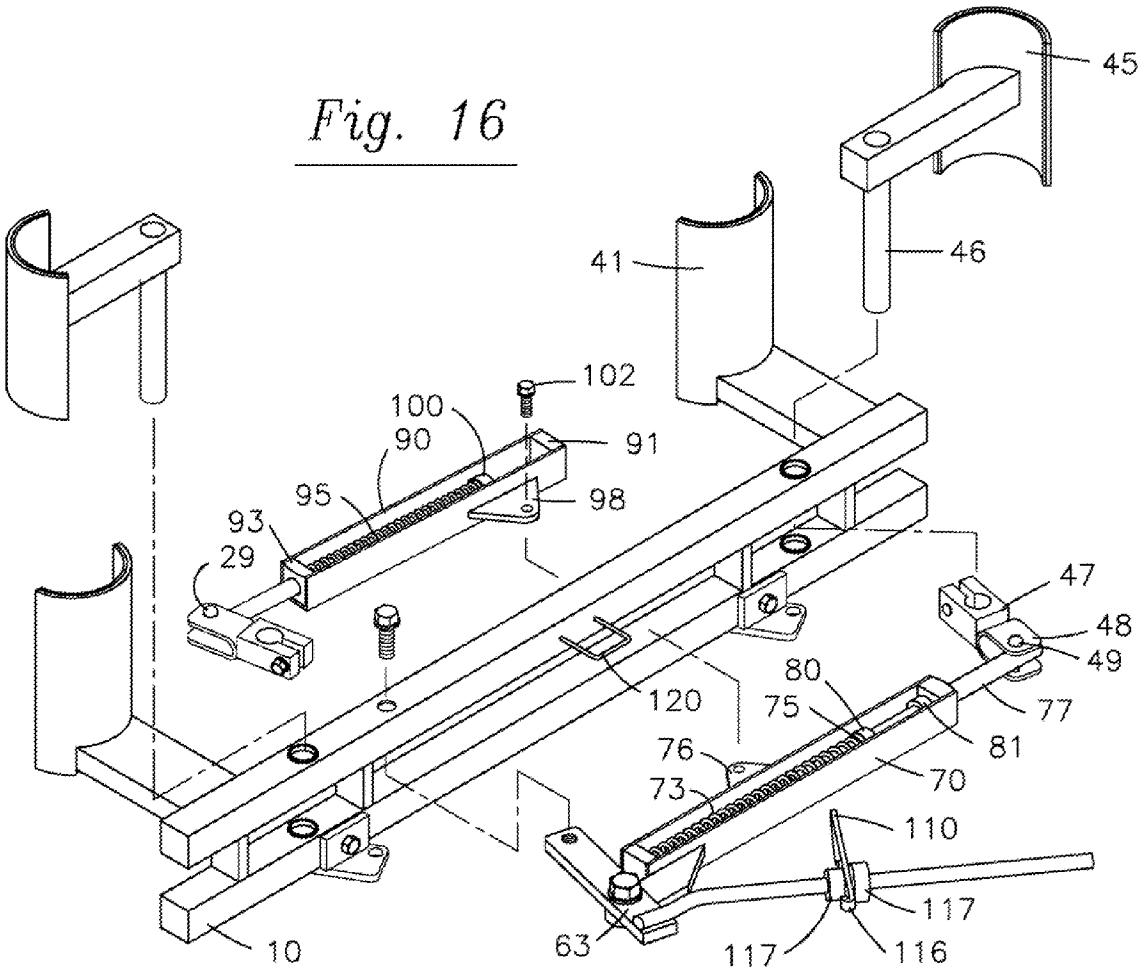
FIG. 16 depicts an exploded view of the invention of FIG. 1.

For the sake of simplicity and to give the claims of this patent application the broadest interpretation and construction possible, the following definitions will apply:

The term "rearward" essentially means toward the rear end of the ATV or other vehicle to which the clamping device is mounted.

The term "forward" essentially means toward the front end of the ATV or other vehicle to which the clamping device is mounted.

The term "inward" essentially means toward a longitudinal axis through the center of the ATV or other vehicle to which the clamping device is mounted.

The term "outward" essentially means toward the outer periphery, away from the longitudinal axis of the ATV or other vehicle to which the clamping device is mounted.

The term "magazine" essentially means a chamber having at least one closed end and at least one insertion opening.

The above terminology is used only as a convenient reference point, to the extent that it is not functionally limiting or narrowing. Also for the sake of simplicity, the conjunctive "and" may also be taken to include the disjunctive "or," and vice versa, whenever necessary to give the claims herein the broadest interpretation and construction possible. Likewise, when the plural form is used, it may be taken to include the singular form, and vice versa.

The invention disclosed herein is not limited by construction materials to the extent that such materials satisfy the structural and/or functional requirements of any claim. For example, although frame or clamp material essentially comprises steel, it may include any material capable of providing the necessary structural rigidity and clamping support. Such materials may include (for example) metals and alloys, polymers and plastics, and mixtures and combinations thereof.

The most general form of the clamping device includes (comprises) a plurality of clamping means and a means of actuating said clamping means. More particularly, the clamping device includes a frame supporting a first clamp and a second clamp, although the invention also encompasses embodiments having more than two clamps. The invention also includes a coordinated-clamping linkage comprising an actuator lever including a handle end (61), a fulcrum end (62) and a mid portion. The actuator lever must satisfactorily cause the clamps to close over the item(s) to be clamped, and usually to allow locking of the closed clamps until desired.

The frame may have almost any structure or configuration that satisfies its function of supporting the clamps and actuation system. In one embodiment wherein each clamp includes a stationary clamp stanchion and a clamping pincer movable against the respective stanchion, the frame includes an essentially rectangular arrangement of steel bars or tubing. For each pincer, there is a pair of aligned vertical bores through both longer sides of the frame, through which a pivot pin is inserted; each pincer is affixed to a respective pivot pin, the pivoting of which moves the pincer into contact with the respective stanchion. There may also be appropriate bearings, bushings or other features to reduce friction or otherwise facilitate the pivoting.

One version of the machine comprises a first clamp including a first stanchion and a first pincer in cooperating relationship with said first stanchion; the first stanchion is affixed atop a first pivot pin downstanding through a first bore through the frame, and affixed to a first actuation arm having a first leverage point. The machine may also include a second clamp comprising a second stanchion and a second pincer in cooperating, relationship with said second stanchion; the second stanchion is affixed atop a second pivot pin downstanding through a second bore through the frame, and affixed to a second actuation arm having a second leverage point.

The coordinated-clamping linkage may include a first clamping linkage including a first pushrod having an inward terminus and an outer terminus; said first pushrod inward terminus is hinge-jointed to the actuator lever intermediate portion. The first pushrod outer terminus includes a first pivot joint attachment to the first actuation arm leverage point. Assuming the machine is centrally mounted on the ATV handlebars in front of the ATV rider, with the actuator lever on the side of the machine nearest to the rider, movement of the actuator lever handle end from a first (rearward) position to a second (forward) position closes the first clamp.

The first pushrod may further include a first yoke flange. The coordinated-clamping linkage may further include a second clamping linkage comprising a second pushrod having an inward terminus and an outer terminus; said second pushrod inward terminus is swivel-linked to said first yoke flange. The second pushrod outer terminus has a second pivot joint attachment to the second actuation arm leverage point. Movement of the actuator lever handle end from a first position to a second position closes both the first clamp and second clamp essentially simultaneously.

The invention also includes a flexible manner of clamping. One such embodiment includes a machine wherein the coordinated-clamping linkage includes a first clamping linkage comprising a first magazine comprising an inward end and an outward end; said first magazine is hinge-jointed near its inward end to the actuator lever mid portion. The first magazine houses a lengthening spring having an inward end and an outward end, said lengthening spring inward end abutting said first magazine inward end, said lengthening spring extending outward toward said first magazine outward end. The coordinated-clamping linkage also includes a first pushrod having an inward terminus and an outer terminus, said first pushrod inward terminus abutting a pushplate abutting the lengthening spring outward end within the first magazine; the first pushrod outer terminus has a first pivot joint, attachment to the first actuation arm leverage point. Movement of the actuator lever handle end from a first position to a second position closes the first clamp; moreover, due to the lengthening spring, the user may move the actuator lever handle end further forward, compressing the lengthening spring, to provide additional clamping strength or to facilitate locking as described elsewhere herein.

Additional flexibility may be achieved if the coordinated-clamping linkage further includes a second clamping linkage comprising a second magazine comprising an inward end and an outward end and a second yoke flange therebetween, said second yoke flange swivel-linked to a first yoke flange on the first magazine. The second magazine outward end further includes a spring detention cap defining a rod port. The second magazine houses a shortening spring having an inward end and an outward end, said shortening spring inward end being near said second magazine inward end, the spring coil extending outward toward the second magazine outer end. Also included is a second pushrod having an inward terminus and an outer terminus. In the shortening spring, assembly, the pushrod is extended into the magazine through the rod port, and threaded through the spring coil to the second magazine inward end; the pushrod inward terminus is attached to a pullplate between the second magazine inward end and the shortening spring inward end. The second pushrod outer terminus has a second pivot joint attachment to the second actuation arm leverage point. Accordingly, movement of the actuator lever handle end from a first position to a second position closes the first clamp and the second clamp essentially simultaneously; moreover, due to the shortening spring, the user may move the actuator lever handle end further past the second position, compressing the shortening spring, to provide additional clamping strength or to facilitate locking as described elsewhere herein.

To add more flexibility, the first magazine and/or the second magazine may further include a respective hatch sized to allow removal of the lengthening and/or shortening spring and replacement with a substitute spring having coil characteristics different, from the spring replaced. (For example, the upper elongated plate of the magazine may be adapted to be removable.) In this manner, the user may vary the clamping strength and/or the clamping clearance between the stanchion and its respective pincer.

In another version of the invention, said first and/or second stanchions and/or first and/or second pincers further include one or more item retention enhancers selected from the group consisting of deformable padding, surface knurling or magnetism, and combinations and mixtures thereof. The characteristic common to all of those group members, justifying inclusion in this group, is the enhancement of the stanchion and/or pincer to grip or otherwise retain whatever item is being clamped. One particular version includes both first and second stanchions and first and second pincers having deformable padding having surface knurling. Such padding and/or knurling may also be included on the entire length of the stanchion, from its connection to the frame to the outer tip of the stanchion.

Additional utility is provided if the machine further includes a means of releasably locking said device in a clamping position. In one particular embodiment, the locking means includes a see-saw mounted latch hook on the actuator lever handle end. Said latch hook includes a rocker end rearward of said see-saw mounting, a foremost point forward of said see-saw mounting, and a forward ramping edge downstanding rearward from said foremost point and terminating in a rearward point defining a notch. The locking means also includes a latch loop affixed to the frame in a cooperating relationship underlying said latch hook foremost point. Clamping occurs upon the movement of the actuator lever handle end from a rearward position toward the frame. In the versions having springs essentially captured within magazines, clamping my occur before the actuator lever handle end is moved to its fully forward position; in other words, the spring biasing of the respective pushrod may cause the respective pincer to close contact with the item to be clamped, and to exert sufficient clamping pressure on that item, even before the pushrod has fully compressed the spring. In this case, the spring(s) within the respective magazine(s) enable the user to move the actuator lever handle additionally forward against the spring biasing, after clamping occurs. Locking occurs when the user moves the actuator lever handle end additionally forward against the spring biasing, until said latch hook forward ramping edge contacts said latch loop, further additional forward movement causing said latch hook to swivel over said latch loop until said latch loop passes said latch hook rearward point and becomes captured within said latch hook notch. Unlocking occurs from the latch loop releasing from the notch when the user moves the actuation handle further additionally forward against the spring biasing, until the latch loop clears the latch hook rearward point; then the user depresses the rocker end and allows the spring biasing to return the actuator lever to a resting unlocked position.

One more specific embodiment is adapted for mounting on an ATV, preferably centered on its handle bars. Besides means of mounting known in the field, this embodiment generally includes a frame (10) supporting a left clamp (20) and a right clamp (40) and a dual-clamping linkage actuating both of said clamps. The right, clamp includes a right stanchion (41) and a right pincer arm (45) in cooperating relationship with said right stanchion; the right pincer arm is affixed atop a right pivot pin (46); the right pivot pin is downstanding through a right bore in the frame, and it carries a right actuation arm (47) having a right actuation arm leverage point (48).

The frame may include a pair of upper and lower horizontal bars, connected by a plurality of support struts at opposite ends and possibly therebetween; each respective stanchion may be affixed to one of those bars, preferably the respective end of the upper bar. There may also be another bore in the lower frame bar, aligned directly beneath the bore in the upper frame bar for the right pivot pin, the right pivot pin therefore downstands through both of said aligned bores in a right portion of the frame, to pivotally support the right pincer arm. The right actuation arm may be carried on a portion of the right pivot pin extending between the upper and lower horizontal frame bars.

One preferred carriage means for the right actuation arm to be attached to the right pivot pin, and thereby be carried by (or around) that pivot pin, is for the end of the actuation arm to essentially include a vise arrangement; near the attachment end of the pivot arm is a vertical bore having a diameter smaller than that of the pivot pin, and a horizontal split at the end of the pivot arm allowing expansion of both split-ends (and consequent expansion of the bore) sufficient for insertion of the pivot pin through the bore; then a connector (such as a bolt, or screw for a threaded bore) is threaded through aligned horizontal bores through each half of the split-end, and the split-end drawn back together (such as by a nut on the end of a bolt, or screw threads through threaded bores) until the desired firmness of attachment is achieved. Such carriage means allows rotation of the pivot pin to cause corresponding rotation of the pivot arm (and travel of its leverage point).

The frame also supports a left clamp on the opposite end of the frame, having main moving elements that, in many respects, are almost mirror-image counterparts to the moving elements of the right clamp; exceptions include the forward orientation of the left actuation arm and the left clamping linkage (discussed more fully below). The left clamping linkage may be linked to the right clamping linkage, which in turn is mechanically linked to the actuation lever handle so that both clamps may be actuated essentially simultaneously.

The dual-clamping linkage may include a spring-lengthened linkage spanning from the actuator handle to the leverage point of the right actuation arm (that actuates the right pincer arm); such physical linkage is partly provided by a pushrod (having an outer end pivotally linked to the right actuation arm leverage point), with the remainder of the linkage being provided by a coiled spring bridging the gap between the free end of the pushrod (within the right magazine) and the end of the magazine linked to the actuator handle. In providing the mechanical linkage, one end of the coil (housed within the magazine) essentially pushes outward against a collar affixed around a mid portion of a shortened pushrod; the coil length therefore augments the length of the pushrod so that, when the right clamp is closed (i.e., the linkage pushes the actuation arm until the pincer contacts the stanchion), the actuator handle may be pushed further to compress the spring and thereby produce additional spring-biased clamping pressure.

More particularly, the spring-lengthened clamping linkage comprises a right magazine (70) including a dosed actuator end (71), and an outward rod-portal end providing a portal facilitating travel of the magazine along a portion of the shortened pushrod within. The tight magazine is hinge-jointed near its actuator end to the actuator lever mid portion (63). The right magazine houses a lengthening coil spring (73) having an actuator end abutting the right magazine actuator end, and an outward pushing end (75). The lengthening spring extends outward (within the magazine) toward the right magazine rod-portal end, remaining fully housed within the magazine. The spring-lengthened clamping linkage also includes a shortened coil-guided pushrod (77) having an inward terminus captured by a portion of the lengthening spring, and an outer terminus pivotally attached (outside the right magazine) to the right actuation arm.

The coil-captured terminus of the shortened pushrod is inserted into the coil of the lengthening spring; the portion of the pushrod captured within the spring helps maintain the longitudinal axis of the spring during, travel within the magazine. A guidering (80) is firmly affixed around a mid portion of the shortened pushrod (within the enclosed right magazine), and it is in contact with the pushing end of the lengthening spring, providing a surface for the lengthening spring to push against and thereby bias the pushrod outward toward a closed-clamping position. The shortened pushrod may also have a second guidering or guidecollar (81) affixed around it, adjacent the point along the pushrod near the rod-portal end of the magazine. (The rod-portal end of the magazine may include a bearing cap defining the final portion of portal outside the magazine; a bushing having flanges within the bearing cap portal may provide additional stability and friction reduction.) This guidecollar, like the guidering, has a function of guiding the travel of the magazine along the pushrod within, especially near the rod-portal end of the magazine.

Said right pivot joint (49) attachment between the outer terminus of the pushrod and the right actuation arm leverage point may, more particularly, include a clevis end attachment. The leverage point of the right actuation arm may essentially terminate in a forked or U-shaped end having a pair of aligned apertures or gudgeons; the outward terminus of the shortened pushrod is received between that fork, and a connecting pin is inserted through those gudgeons and an aligned bore through the outward terminus of the pushrod. In this manner, longitudinal movement of the shortened pushrod is received by the leverage point of the actuation arm, which causes rotation of the pivot pin to actuate clamping.

Movement of the actuator lever handle end from a rearward position to a forward position closes the right clamp; moreover, due to the lengthening spring, further movement of the actuator lever handle end forward causes compression of the lengthening spring, to provide additional clamping strength (spring tension) or to facilitate locking of the latch hook on the latch loop, as described elsewhere herein.

The dual-clamping linkage may also include a coiled pistonrod linkage spanning from the leverage point of the left actuation arm (that actuates the left pincer arm) to the left magazine yoke connection with the right magazine. Such physical linkage is provided primarily by a pistonrod having an outer end pivotally linked to the left actuation arm leverage point, and having a substantial portion housed within the left magazine; that portion impales a coil spring biasing that portion to occupy essentially the entire length of the left magazine when the left clamp is in an unclamped resting position. In such mechanical linkage, the coilspring is entirely captured by the portion of the pistonrod within the magazine, one end of the coilspring pushing against the outward wall of left magazine having a pistonrod-port providing a port facilitating travel of the left magazine along the pistonrod within. The other end of the coilspring pushes against a pistonrod guide-end adjacent the opposite closed end of the left magazine. The pistonrod guide-end is similar to the guidering of the right magazine (providing a surface for the coilspring to push against), the difference being that the coilspring captured on the pistonrod (between the guide-end and the pistonrod-port) biases the left magazine to maximize the length of the pistonrod within the magazine when the left clamp is in an open-clamping resting position.

More particularly, the coiled pistonrod linkage comprises a left magazine (90) comprising an inward endstop end (91) and an outward pistonrod-port end providing a port facilitating travel of the left magazine along the coil-captured portion of the left pistonrod. (99). There is a left yoke flange (98) outstanding from the left magazine, between its ends; said left yoke flange is swivel-linked (102) to a right yoke flange (76) outstanding from the right magazine, thereby achieving the physical linkage between the two magazines. The left magazine (outward) pistonrod-port end further includes a spring detention cap (93) defining the pistonrod-port, through which the pistonrod extends while the coilspring (95) remains impaled on the portion of the pistonrod within the left magazine.

In the coiled pistonrod assembly, the pistonrod extends into the left magazine through its pistonrod-port, and a portion of the pistonrod is threaded through the entire length of the coilspring to the left magazine endstop, the pistonrod terminates in a guideplate (100). The left pistonrod outer terminus has a left pivot joint attachment (29) to the left actuation arm leverage point. Because the coilspring is captured by the portion of the pistonrod within the left magazine, pushing against the magazine endstop and the pistonrod guideplate, it biases the left magazine to maximize the length of the pistonrod within the magazine when the left clamp is in an open-clamping resting position.

Movement of the actuator lever handle end from a rearward position to a forward position closes the left clamp via the essentially simultaneous closing of the right clamp; moreover, due to the coiled pistonrod linkage of the left magazine, the user may move the actuator lever handle end further forward, compressing the coilspring while the left magazine travels inward along the pistonrod (creating or widening a gap between the inward endstop end of the left magazine and the adjacent left pistonrod guideplate terminus), to provide additional clamping strength or to facilitate locking as described elsewhere herein.

In another version of the invention, said right and/or left stanchions and/or right and/or left pincers further include one or more item retention enhancers selected from the group consisting of deformable padding, surface knurling or magnetism, and combinations and mixtures thereof. The characteristic common to all of those group members, justifying inclusion in this group, is the enhancement of the stanchion and/or pincer to grip or otherwise retain whatever item is being clamped. One particular version includes both right and left stanchions and right and left pincers having deformable padding having surface knurling. Such padding and/or knurling may also be included on the entire length of the stanchion, from its connection to the frame to the outer tip of the stanchion.

Additional utility is provided if the device further includes a means of releasably locking said device in a clamping position. In one particular embodiment, the locking means includes a see-saw mounted latch hook (110) on the actuator lever handle end. A rearward rocker end portion of the latch hook is essentially impaled upon the actuator handle, between a pair of collars (117); each collar is similarly impaled upon the actuator handle, but (unlike the latch hook) affixed to the actuator handle by tightening of a screw or bolt within threaded bores extending from the perimeter of each collar to its center abutting the actuator handle; such tightening allows adjustment of the space between both collars (within which the latch hook see-saws).

Said latch hook includes a rocker end (116) rearward of said see-saw mounting, a foremost point (111) forward of said see-saw mounting, and a forward ramping edge (112) downstanding rearward from said foremost point and terminating in a rearward point (113) defining a notch. The locking means also includes a latch loop (120) affixed to the frame in a cooperating relationship underlying said latch hook foremost point.

Clamping occurs upon the movement of the actuator lever handle end from a rearward position toward the frame. During such forward movement, the foremost point of the latch hook moves toward the latch loop until its forward ramping edge contacts the latch loop; continued forward movement causes the latch hook to ramp up the latch loop until its rearward point passes over the latch loop, and gravity causes the latch hook to lower over the latch loop until the latch loop is cradled in the notch of the latch hook. Adjustment of the orientation or "tilt" of the latch hook on the see-saw mount (especially adjustment of where on the forward ramping edge the latch loop makes contact during latching), may be accomplished if at least one of the collars includes a roll pin fully or substantially spanning the space between both collars (within which the latch hook see-saws), with the latch hook resting upon that roll pin; besides adjusting the width of that space between the collars, the adjustment screw(s) or bolt(s) of the collar(s) will enable the user to adjust the height of that roll pin, and thereby adjust the angle at which the latch hook rests.

In the versions having clamping linkage(s) including the spring(s) essentially captured within the magazine(s), clamping my occur before the actuator lever handle end is moved to its fully forward position; in other words, the spring biasing of the respective pushrod or pistonrod may cause the respective pincer to close contact with the item to be clamped, and to exert sufficient clamping, pressure on that item, even before the pushrod or pistonrod has fully compressed its spring. In this case, the spring(s) within the respective magazine(s) enable the user to move the actuator lever handle additionally forward against the spring biasing, after clamping occurs.

Locking occurs when the user moves the actuator lever handle end additionally forward against the spring biasing until said latch hook forward ramping edge contacts said latch loop, further additional forward movement causing said latch hook to see-saw upward over said latch loop until said latch loop passes said latch hook rearward point and becomes captured within said latch hook notch. Unlocking occurs from the latch loop releasing from the notch when the user moves the actuation handle additionally forward against the spring biasing, until the underlying latch loop clears the latch hook rearward point; then the user depresses the rocker end and allows the spring biasing to return the actuator lever to a resting unlocked position.

Besides the machine disclosed herein, the invention also includes method of using a device described herein. One general version of the method includes the steps of positioning an item between the left and right clamps, and moving the actuator lever forward until the item is clamped by both the left and right clamps. The method may further include locking the device using the steps comprising moving the actuator lever handle end additionally forward against the spring biasing until the latch hook see-saws upward over the latch loop and the latch loop becomes captured within the latch hook notch.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

I claim:

1. A machine for essentially simultaneously clamping an item releasably with a plurality of clamps, said machine comprising a plurality of clamping means and a means of actuating said clamping means, said machine comprising:

(a) a frame supporting a first clamp and a second clamp, said first clamp comprising a first stanchion and a first pincer in cooperating relationship with said first stanchion and affixed atop a first pivot pin downstanding through a first bore defined by the frame and affixed to a first actuation arm having a first leverage point, said second clamp comprising a second stanchion and a second pincer in cooperating relationship with said second stanchion and affixed atop a second pivot pin downstanding through a second bore defined by said frame and affixed to a second actuation arm having a second leverage point; and (b) a coordinated-clamping linkage comprising an actuation lever including a handle end, a fulcrum end and a mid portion, and a first clamping linkage comprising a first pushrod having a first pushrod inward terminus and a first pushrod outer terminus, said first pushrod inward terminus hinge-jointed to the actuation lever intermediate portion, said first pushrod outer terminus having a first pivot joint attachment to the first actuation arm leverage point, the first pushrod further comprising a first yoke flange, and further comprising a second clamping linkage comprising a second pushrod having a second pushrod inward terminus and a second pushrod outer terminus, said second pushrod inward terminus swivel-linked to said first yoke flange, said second pushrod outer terminus having a second pivot joint attachment to the second actuation arm leverage point, wherein movement of the actuation lever handle end from a first position to a second position closes both the first clamp and second clamp essentially simultaneously.

2. A machine described in claim 1, the coordinated-clamping linkage comprising a first clamping linkage comprising:

(a) a first magazine comprising a first magazine inward end and a first magazine outward end, said first magazine hinge-jointed near said first magazine inward end to the actuation lever mid portion, said first magazine housing;

(b) a lengthening spring having a lengthening spring inward end and a lengthening spring outward end, said lengthening spring inward end abutting said first magazine inward end and extending outward toward said first magazine outward end; and (c) a first pushrod having a first pushrod outer terminus and a first pushrod inward terminus abutting a pushplate abutting said lengthening spring outward end within said first magazine, said first pushrod outer terminus having a first pivot joint attachment to the first actuation arm leverage point;

wherein movement of the actuation lever handle end from a first position to a second position closes the first clamp.

3. A machine described in claim 2, the first magazine further comprising a first hatch sized to allow removal of the lengthening spring and replacement with a substitute lengthening spring having coil characteristics different from the lengthening spring.

4. A machine described in claim 2, the first magazine further comprising a first yoke flange, the coordinated-clamping linkage further comprising a second clamping linkage comprising:

(a) a second magazine comprising a second magazine inward end, a second magazine outward end including a spring detention cap defining a rod port, and a second yoke flange therebetween, said second yoke flange swivel-linked to said first yoke flange, said second magazine housing;

(b) a shortening spring having a shortening spring inward end near said second magazine inward end and a shortening spring outward end, said shortening spring extending outward toward said second magazine outward end; and (c) a second pushrod having a second pushrod inward terminus and a second pushrod outer terminus, said second pushrod extending into said second magazine through said rod port and threading through said shortening spring to said second magazine inward end, said second pushrod inward terminus attaching to a pullplate between said second magazine inward end and said shortening spring inward end, said second pushrod outer terminus having a second pivot joint attachment to the second actuation arm leverage point;

wherein movement of the actuation lever handle end from a first position to a second position closes the first clamp and the second clamp essentially simultaneously.

5. A machine described in claim 4, the second magazine further comprising a second hatch sized to allow removal of the shortening spring and replacement with a substitute shortening spring having coil characteristics different from the shortening spring.

6. A machine described in claim 4, unlocking occurring from said latch loop releasing from said notch when the user moves the actuation handle further additionally forward against the spring until the underlying latch loop clears the latch hook rearward point, then the user depressing the rocker end and allows the spring biasing to return the actuation lever to a resting unlocked position.

7. A machine described in claim 3, the locking means comprising:

(a) a see-saw mounted latch hook on the actuation lever handle end, said latch hook comprising a rocker end rearward of said see-saw mounting, a foremost point forward of said see-saw mounting, and a forward ramping edge downstanding rearward from said foremost point and terminating in a rearward point defining a notch; and (b) a latch loop affixed to the frame in a cooperating relationship underlying said latch hook foremost point;

clamping occurring upon the movement of the actuation lever handle end from a rearward position to a less than fully forward position, at least one spring within a magazine enabling the user to move the actuation lever handle additionally forward against said spring biasing after said clamping occurs;

locking occurring when the user moves the actuation lever handle end additionally forward against the spring biasing until said latch hook foreward ramping edge contacts said latch loop, additional forward movement causing said latch hook to see-saw upward over said latch loop until said latch loop passes said latch hook rearward point and becomes captured within said latch hook notch.

8. A device described in claim 7, unlocking occurring from said latch loop releasing from said notch when the user moves the actuation handle additionally forward against the spring until the underlying latch loop clears the latch hook rearward point, then the user depressing the rocker end and allows the spring biasing to return the actuation lever to a resting unlocked position.

9. A machine described in claim 1, said first and second stanchions and first and second pincers further comprising item retention enhancers selected from the group consisting of deformable padding, surface knurling or magnetism, and combinations and mixtures thereof.

10. A device described in claim 9, said left and right clamps further comprising deformable padding having surface knurling.

11. A device described in claim 9, further comprising a means of releasably locking said device in a clamping position.

12. A machine described in claim 1, said first and second stanchions and first and second pincers further comprising deformable padding having surface knurling.

13. A machine described in claim 1, further comprising a means of releasably locking said device in a clamping position.

14. A device described in claim 13, the locking means comprising:

(a) a see-saw mounted latch hook on the actuation lever handle end, said latch hook comprising a rocker end rearward of said see-saw mounting, a foremost point forward of said see-saw mounting, and a forward ramping edge downstanding rearward from said foremost point and terminating in a rearward point defining a notch; and (b) a latch loop affixed to the frame in a cooperating relationship underlying said latch hook foremost point;

clamping occurring upon movement of the actuation lever handle end from a rearward position to a less than fully forward position, at least one spring within a magazine enabling the user to move the actuation lever handle additionally forward against said spring biasing after said clamping occurs;

locking occurring when the user moves the actuation lever handle end additionally forward against the spring biasing until said latch hook foreward ramping edge contacts said latch loop, additional forward movement causing said latch hook to see-saw upward over said latch loop until said latch loop passes said latch hook rearward point and becomes captured within said latch hook notch.

15. A method of using a device described in claim 1, comprising the steps of positioning an item between the left and right clamps, and moving the actuation lever forward until the item is clamped by both the left and right clamps.

16. A device for mounting on a vehicle for essentially simultaneously clamping an item releasably with a pair of clamps, said device comprising a frame supporting a left clamp and a right clamp and a dual-clamping linkage actuating both of said clamps:

(a) said right clamp comprising;

(1) a right stanchion; and (2) a right pincer in cooperating relationship with said right stanchion and affixed atop a right pivot pin downstanding through a right bore defined by said frame and affixed to a right actuation arm having a right actuation arm leverage point;

(b) said left clamp comprising;

(1) a left stanchion; and (2) a left pincer in cooperating relationship with said left stanchion and affixed atop a left pivot pin downstanding through a left bore defined by said frame and affixed to a left actuation arm having a left actuation arm leverage point;

(c) said dual-clamping linkage comprising a right clamping linkage comprising:

(1) an actuation lever including a handle end, a fulcrum end and mid portion;

(2) a right magazine comprising a right magazine inward end and a right magazine outward end and a right yoke flange therebetween, said right magazine hinge-jointed near the right magazine inward end to the actuation lever mid portion, said right magazine housing;

(3) a lengthening spring having a lengthening spring inward end and a lengthening spring outward end, said lengthening spring inward end anchored within said right magazine inward end and extending outward toward said right magazine outward end; and (4) a right pushrod having a right pushrod inward terminus and a right pushrod outer terminus abutting a pushplate abutting said lengthening spring outward end within said first magazine, said right pushrod outer terminus having a first pivot joint attachment to said right actuation arm leverage point, said right pushrod inward terminus affixed to said lengthening spring outward end within said right magazine, said right pushrod outer terminus having a right pivot joint attachment to said right actuation arm leverage point;

(d) said dual-clamping linkage further comprising a left clamping linkage comprising:

(1) a left magazine comprising a left magazine inward end, a left magazine outward end including a spring detention cap defining a rod port, and a left yoke flange therebetween, said left yoke flange swivel-linked to said right yoke flange, said left magazine housing;

(2) a shortening spring having a shortening spring inward end near said left magazine inward end and a shortening spring outward end, said shortening spring extending outward toward said left magazine outward end; and (3) a left pushrod having a left pushrod inward terminus and a left pushrod outer terminus, said left pushrod extending into said left magazine through said rod port and threading through said shortening spring to said left magazine inward end, said left pushrod inward terminus attaching to a pullplate between said left magazine inward end and said shortening spring inward end, said left pushrod outer terminus having a left pivot joint attachment to the left actuation arm leverage point;

wherein movement of the actuation lever handle end from a rearward position to a forward position closes the right clamp and the left clamp essentially simultaneously.

17. A method described in claim 16, further comprising locking the device using the steps comprising moving the actuation lever handle end additionally forward against the spring biasing until the latch hook see-saws upward over the latch loop and the latch loop becomes captured within the latch hook notch.

* * * * *